US006943730B2

(12) United States Patent
Poilasne et al.

(10) Patent No.: US 6,943,730 B2
(45) Date of Patent: Sep. 13, 2005

(54) LOW-PROFILE, MULTI-FREQUENCY, MULTI-BAND, CAPACITIVELY LOADED MAGNETIC DIPOLE ANTENNA

(75) Inventors: Gregory Poilasne, San Diego, CA (US); Jeff Shamblin, San Marcos, CA (US); Laurent Desclos, San Diego, CA (US); Sebastian Rowson, San Diego, CA (US)

(73) Assignee: Ethertronics Inc., San Diego, CA (US)

( * ) Notice: Subject to any disclaimer, the term of this patent is extended or adjusted under 35 U.S.C. 154(b) by 0 days.

(21) Appl. No.: 10/133,717

(22) Filed: Apr. 25, 2002

(65) Prior Publication Data

US 2003/0201942 A1 Oct. 30, 2003

(51) Int. Cl.[7] ..... H01Q 1/38

(52) U.S. Cl. ..... 343/700 MS; 343/702; 343/846

(58) Field of Search ..... 343/700 MS, 702, 343/846, 848, 895, 909, 741, 793; H01Q 1/38

(56) References Cited

U.S. PATENT DOCUMENTS

| | | | |
|---|---|---|---|
| 3,827,053 | A | 7/1974 | Willie et al. |
| 4,450,449 | A | 5/1984 | Jewitt |
| 4,598,276 | A | 7/1986 | Tait |
| 4,749,996 | A | 6/1988 | Tresselt |
| 5,087,922 | A | 2/1992 | Tang et al. |
| 5,241,321 | A | 8/1993 | Tsao |

(Continued)

FOREIGN PATENT DOCUMENTS

| | | | |
|---|---|---|---|
| EP | 0 604 338 | A | 6/1994 |
| EP | 0 942 488 | A | 9/1999 |
| EP | 1 067 627 | A | 1/2001 |
| JP | 56 012102 | | 2/1981 |
| JP | 09 055621 | A | 2/1997 |
| JP | 2000 031735 | A | 1/2000 |
| JP | 2000 068736 | A | 3/2000 |

OTHER PUBLICATIONS

International Search Report for application PCT/US03/37031 dated Apr. 5, 2004.

International Seach Report from PCT Application No. PCT/US02/20242.

Wheeler, "Small Antennas." IEEE Transactions on Antennas and Propagation, 462–468, Jul. 1975.

Sievenpiper et al., "High impedance electromagnetic surfaces, with a forbidden frequency band." IEEE Transactions on Microwave Theory and Techniques, 47(11): 2059–2074, 1999.

International Search Report for application PCT/US03/12725.

*Primary Examiner*—Hoanganh Le
(74) *Attorney, Agent, or Firm*—G. Peter Albert, Jr.; Foley & Lardner, LLP

(57) ABSTRACT

A design and physical configuration for multi-frequency, low-profile, capacitively loaded magnetic dipole (CLMD) antennas to be used in wireless communications. One component of the CLMD antenna having one to three metal plates, and one component having one to n elements. The range of frequencies covered to be determined by the shape, size, and number of elements in the physical configuration of the components.

50 Claims, 14 Drawing Sheets

U.S. PATENT DOCUMENTS 5,245,745 A 9/1993 Jensen et al.
5,309,164 A 5/1994 Dienes et al.
5,680,144 A * 10/1997 Sanad ..... 343/700 MS
5,764,190 A 6/1998 Murch et al.
5,835,063 A 11/1998 Brachat et al.
5,917,450 A * 6/1999 Tsunekawa et al. .. 343/700 MS
5,936,583 A 8/1999 Sekine et al.
5,936,590 A 8/1999 Funder
5,966,096 A 10/1999 Brachat
5,986,606 A 11/1999 Kossiavas et al.
6,002,367 A 12/1999 Engblom et al.
6,008,764 A 12/1999 Ollikainen et al.
6,046,707 A 4/2000 Gaughan et al.
6,140,965 A 10/2000 Van Hoozen
6,140,969 A 10/2000 Lindenmeier et al.
6,147,649 A 11/2000 Irvissimtzis et al.
6,157,348 A 12/2000 Openlander
6,181,281 B1 1/2001 Desclos et al.
6,211,815 B1 4/2001 Richey et al.
6,229,485 B1 * 5/2001 Ito et al. ..... 343/700 MS
6,246,371 B1 6/2001 Kurz et al.
6,304,222 B1 10/2001 Smith et al. ..... 343/702
6,339,409 B1 1/2002 Warnagiris
6,348,894 B1 2/2002 Lahti ..... 343/702
6,362,789 B1 3/2002 Trumbull et al.
6,366,258 B2 4/2002 Reece et al.
6,369,777 B1 4/2002 Ohara et al.
6,417,807 B1 7/2002 Hsu et al.
6,456,243 B1 * 9/2002 Poilasne et al. ..... 343/700 MS
6,529,749 B1 3/2003 Hayes et al.
6,538,601 B2 3/2003 Bruno et al.
6,538,621 B1 * 3/2003 Sievenpiper et al. . 343/700 MS
6,567,053 B1 * 5/2003 Yablonovitch et al. ..... 343/700 MS
6,675,461 B1 * 1/2004 Rowson et al. ..... 29/600
2002/0126052 A1 9/2002 Boyle

* cited by examiner

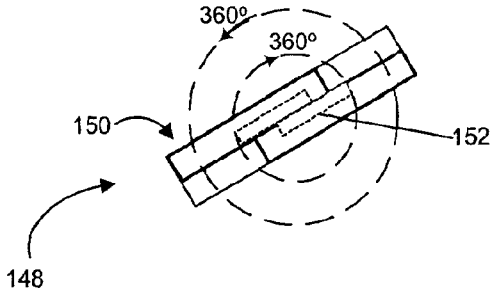
FIG. 5A
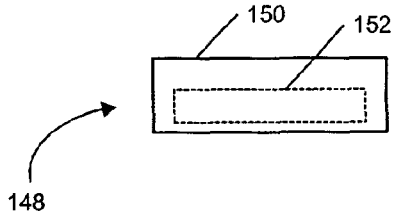
FIG. 5B
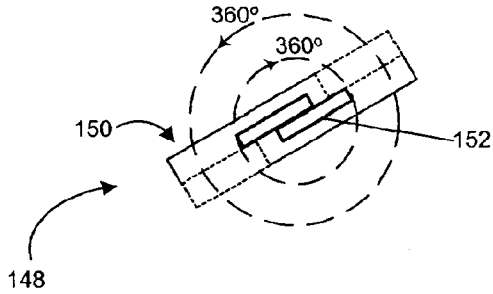
FIG. 5C
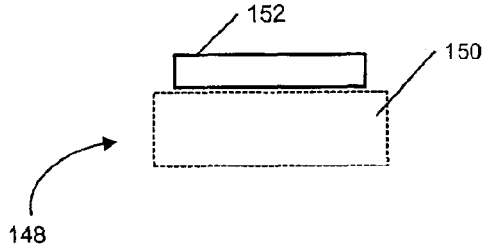
FIG. 5D
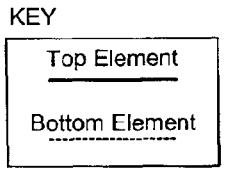

KEY

Top Element

Bottom Element

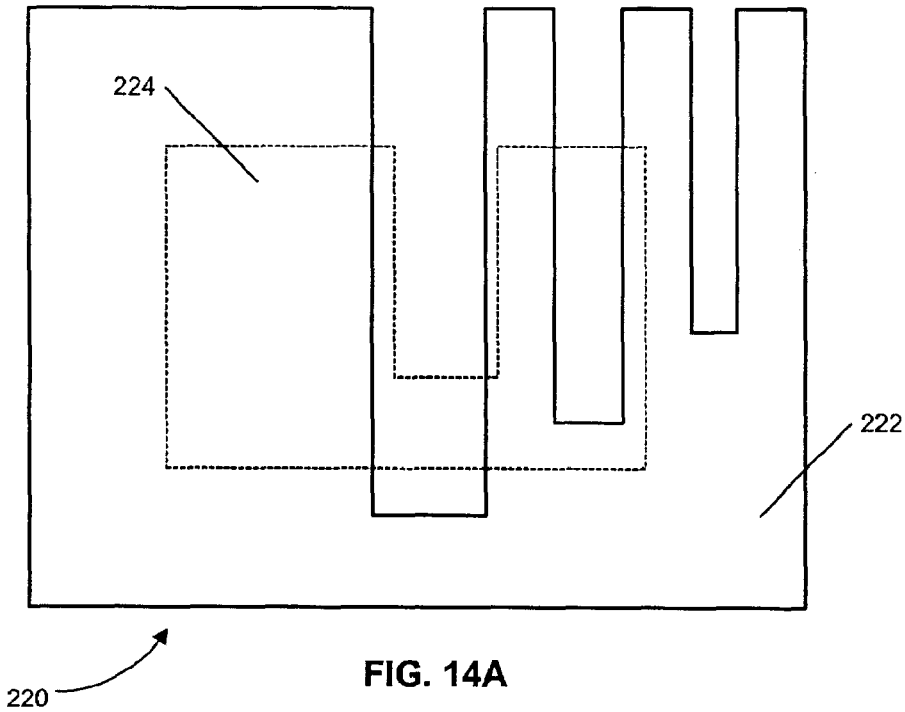
FIG. 14A
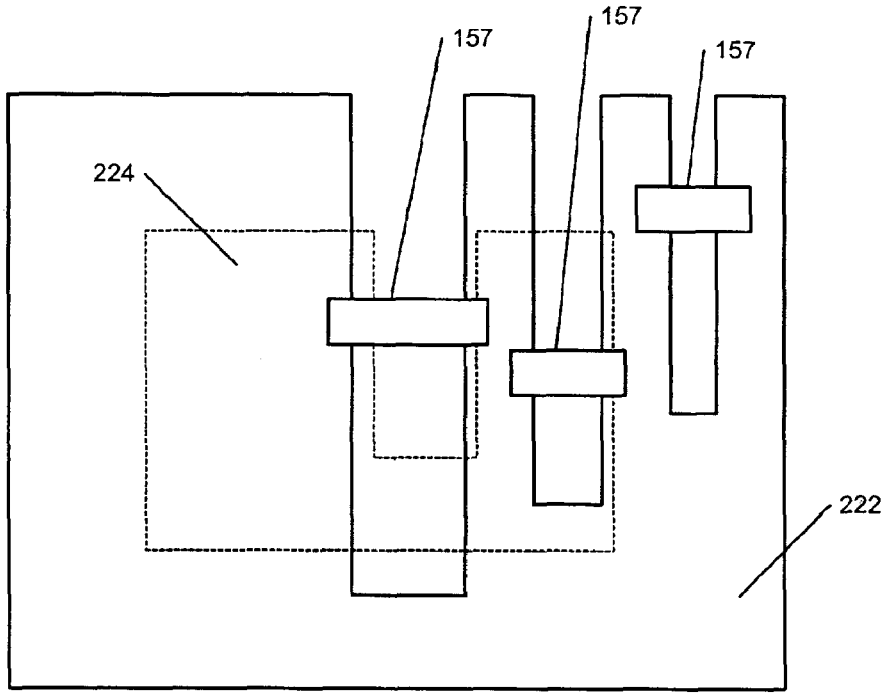
FIG. 14B
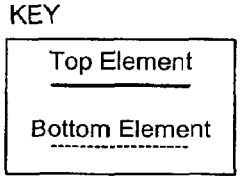

LOW-PROFILE, MULTI-FREQUENCY, MULTI-BAND, CAPACITIVELY LOADED MAGNETIC DIPOLE ANTENNA

1. CROSS-REFERENCE TO RELATED APPLICATIONS

This application relates to application Ser. No. 09/892,928, filed on Jun. 26, 2001, entitled "Multi Frequency Magnetic Dipole Antenna Structure and Methods Reusing the Volume of an Antenna" by L. Desclos et al., owned by the assignee of this application and incorporated herein by reference.

This application relates to application Ser. No. 10/076922, entitled "Multi Frequency Magnetic Dipole Antenna Structures with a New E-Field Distribution for Very Low-Profile Antenna Applications" by G. Poilasne et al., owned by the assignee of this application and incorporated herein by reference.

BACKGROUND INFORMATION

1. Field of the Invention

The present invention relates generally to the field of wireless communications, and particularly to multi-band antennas used in wireless communications.

2. Background

Certain wireless communication applications such as the Global System for Mobile Communications (GSM) and Personal Communications Service (PCS) require that multiple bands be accessible, depending upon the local frequency coverage available from a service provider. Because applications such as GSM and PCS are used in the context of wireless communications devices that have relatively small form-factors, a low profile is also required.

The present invention addresses the requirements of certain wireless communications applications by providing configurations for low profile, multi-frequency, multi-band, capacitively loaded magnetic dipole (CLMDs) antennas.

SUMMARY OF THE INVENTION

The present invention discloses a myriad physical arrangements of multiple antenna elements configured to cover one to n number of frequencies or bands of frequencies.

In the present invention, the antenna elements include both inductive and capacitive parts. Each element can provide a single frequency or band of frequency. The physical design of each element can vary, but the design allows for multiple frequencies by using a plurality of single elements to provide a multi-frequency antenna.

In one embodiment, a single element has two top plates and a bottom plate. In another embodiment a single element has one u-shaped top plate and one bottom plate. Each element produces a specific frequency or band of frequencies based on its relative size and shape. Different physical configurations can be considered to adapt the antenna and its elements to the physical environment specific to a particular application. In each case, each plate is connected to the ground and only one plate is connected to a feeding point.

Once the plates have been cut and folded into the desired form for the purpose of matching a frequency or frequency band, the elements can be arranged to target multiple bands. In one embodiment, the elements can be placed one next to the other. In another embodiment, the elements can be stacked, one on top of another. In yet another embodiment, the elements can be inserted one inside the other. A multi-frequency, multiband, capacitively loaded magnetic dipole (CLMD) antenna is configured by arranging the multiple elements to both meet the frequency and space requirements of the specific application.

Further features and advantages of this invention as well as the structure and operation of various embodiments are described in detail below with reference to the accompanying drawings.

This summary does not purport to define the invention. The invention is defined by the claims.

BRIEF DESCRIPTION OF THE DRAWINGS

The foregoing aspects and many of the attendant advantages of this invention will become more readily appreciated by reference to the following detailed description, when taken in connection with the accompanying drawings, wherein:

FIG. 5A is a top-view an alternative embodiment of an antenna in accordance with the present invention;

FIG. 5B is a side view of the antenna of FIG. 5A;

FIG. 5C is an alternative embodiment of the antenna of FIG. 5A;

FIG. 5D is a side view of the antenna of FIG. 5C;

FIGS. 14A and 14B are top views of alternative embodiment of CLMD antennas according to the present invention.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

A CLMD antenna produces a specific frequency, band of frequency, or combination therein for a targeted applications like Global System for Mobile Communications (GSM) and Personal Communications Service (PCS). The resonant frequency is a result of the inductance and capacitance. CLMD antennas present various advantages, chief among them is excellent isolation. Different configurations of the CLMD antennas are available which have varying degrees of isolation and different bandwidths.

Figure 1A:
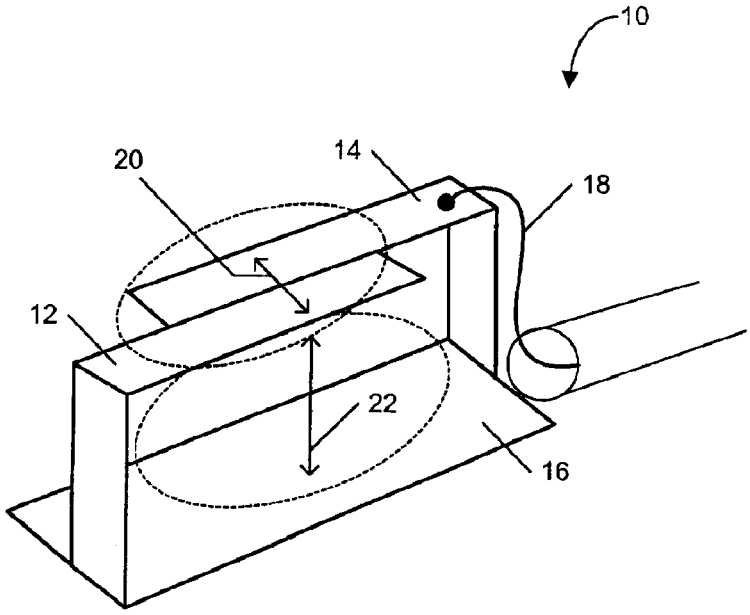
FIG. 1A is perspective view of an antenna which can be used as a component in accordance with the present invention.

FIG. 1A illustrates one embodiment of a single-element CLMD antenna 10 that can be used in accordance with the present invention. The CLMD antenna 10 comprises two top plates 12 and 14, a bottom plate 16, and an antenna feed line 18. The two top plates 12 and 14 create the capacitive part 20 of antenna 10 and the loop between the two top plates 12 and 14 and the bottom plate 16 creates the inductive part 22 of antenna 10. The electric field is confined in the capacitive part 16 of antenna 10 and the magnetic field is expelled in the inductive part 22 of antenna 10. Power is supplied to the antenna 10 through the feed line 18. In FIG. 1A, the feed line 18 is a coaxial cable with the inner conductor connected to one top plate 14 and the outer conductor connected to the bottom plate 16, which serves as ground.

Figure 1B:
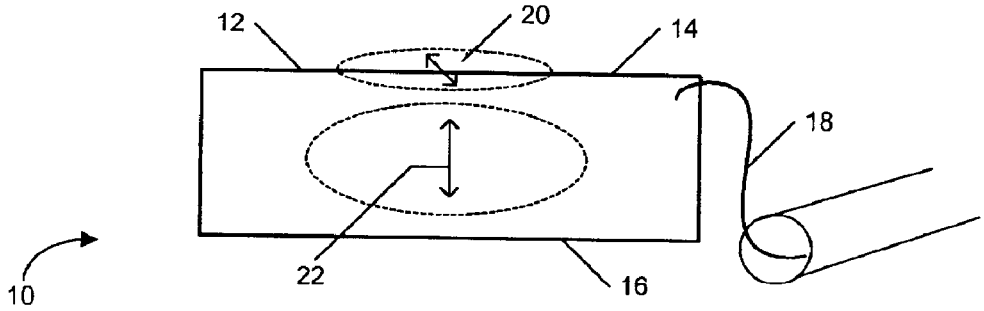
FIG. 1B is a side view of the antenna component of FIG. 1A.

FIG. 1B illustrates a side-view of antenna 10. As can be seen the two top plates 12 and 14 create the capacitive part 20 of the antenna 10 while the loop between the two top plates 12 and 14, and the bottom plate 16 creates the inductive part 22. The far field of such an antenna is actually due to the expelled field, mainly magnetic, in the area closely surrounding the antenna 10.

Figure 1C:
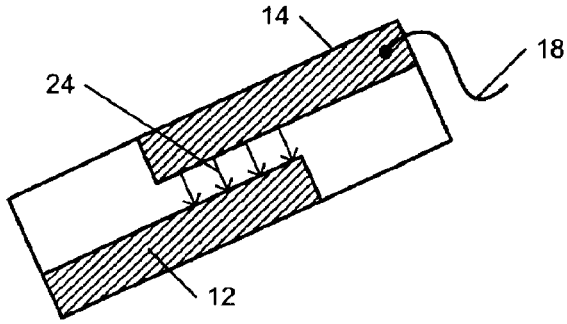
FIG. 1C is a top view of the antenna component of FIG. 1A.

FIG. 1C illustrates a top-view of antenna 10 with a horizontal electric field 24 shown between the two top plates 12 and 14 in accordance with the present invention. The horizontal electric field 24 allows for a lower antenna profile, because electric field 24 is confined in a horizontal orientation as opposed to a vertical orientation. The electric field confinement can be optimized and frequency bandwidth can be tuned, at least in part, by adjusting the distance between the two top plates 12 and 14. For example, increasing the distance between the two top plates 12 and 14, which increases the antenna mode volume, can enlarge the frequency bandwidth. Increasing the antenna mode volume will result in more leaks around the antenna. On the other hand, as confinement increases, the isolation increases, but the bandwidth becomes narrower. Thus, isolation and bandwidth can be optimized by adjusting the distance between the two top plates 12 and 14.

Figure 2A:
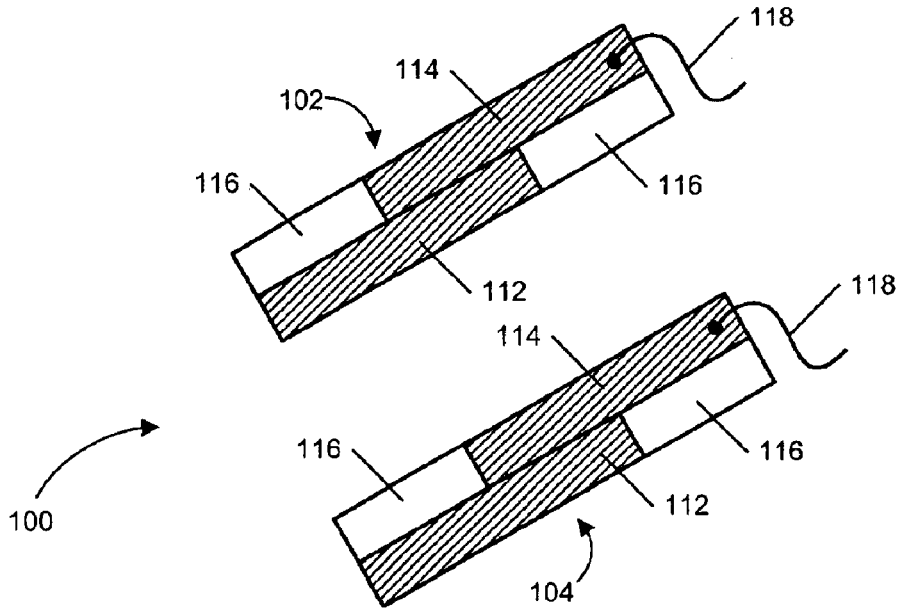
FIG. 2A is a top view one embodiment of an antenna in accordance with the present invention.

Turning now to FIG. 2A, one embodiment of a multi-element, multi-frequency, either mono or dual band CLMD antenna in accordance with the present invention is shown as reference numeral 100. Antenna 100 comprises two separate CLMD antenna components 102 and 104, such as antenna 10 shown in FIG. 1A, placed one beside the other. The antenna components 102 and 104 each include two top plates 112 and 114, one bottom plate 116, and a feed line 118 connected to one top plate 114. The antenna components 102 and 104 are configured to operate at different frequencies within a specified frequency range. In this configuration, the frequency characteristics of antenna components 102 and 104 combine to give antenna 100 a frequency range including the combined operating frequencies of both antenna components 102 and 104.

Figure 2B:
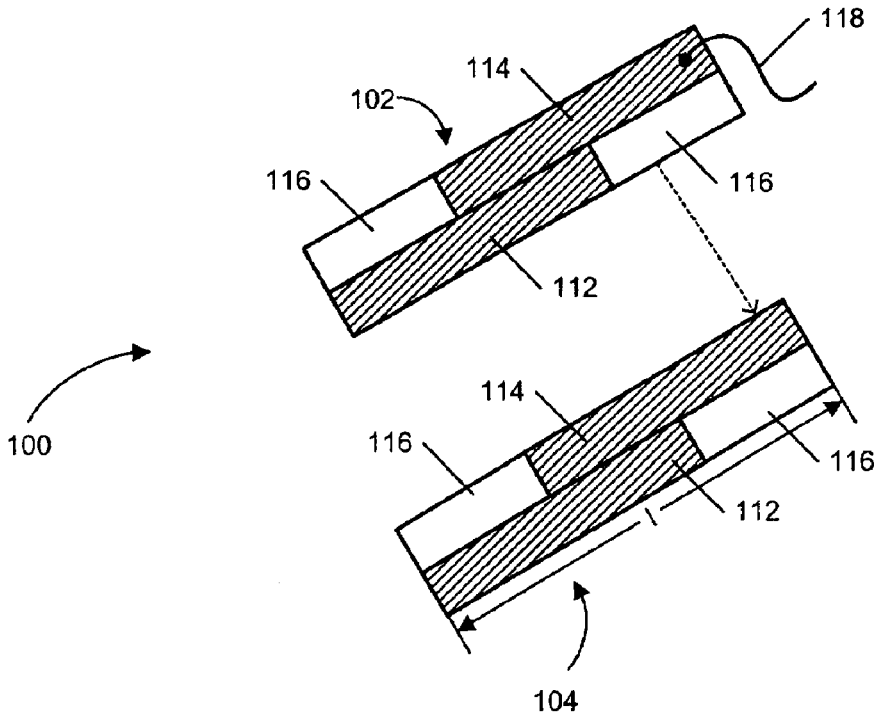
FIG. 2B is a top view of one alternative embodiment of the antenna of FIG. 2A.

An alternative embodiment of the antenna 100 is shown in FIG. 2B. In this embodiment, only one antenna component 102 is connected to the feed line 118. In this configuration, antenna component 104 is excited by a magnetic coupling 120 coming from antenna component 102. As in the previous embodiment, each antenna component 102 and 104 is configured to operate at a different frequency within a specified frequency range giving the resulting antenna 100 a frequency range that includes the combined operating frequencies of both antenna components 102 and 104. In this configuration, 1 to n parasitic components can be coupled to the component connected to the feed line 118.

Figure 3A:
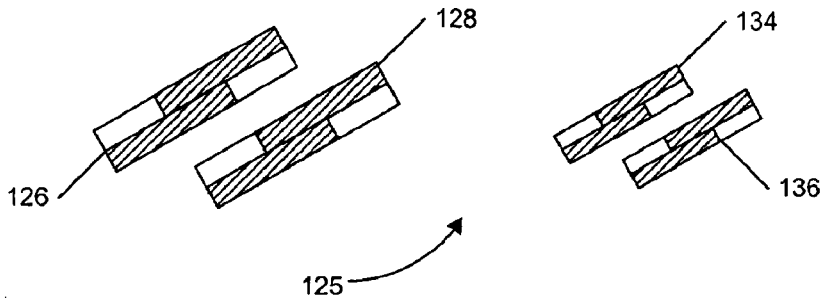
FIG. 3A is a top view of another embodiment of an antenna in accordance with the present invention.
Figure 3B:
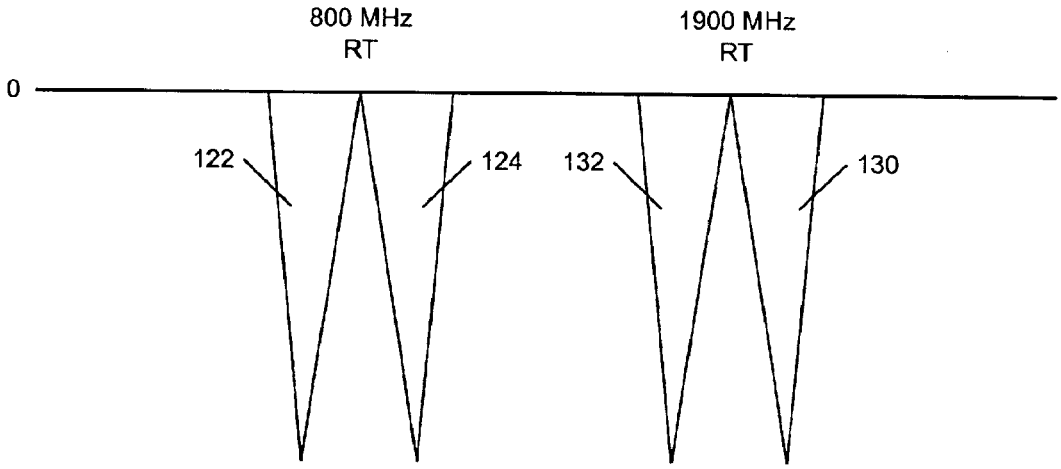
FIG. 3B is a frequency graph corresponding to the coverage of the antenna shown in FIG. 3A.

The antenna components 102 and 104 presented in FIGS. 2A and 2B can be sized for very different frequency ranges making it possible to obtain the multi-frequency, multi-band CLMD antenna 125 shown in FIG. 3A. Reference numerals 122 and 124, of FIG. 3B, are the graphical representations of the frequencies covered by two larger components 126 and 128, of FIG. 3A, and reference numerals 130 and 132 are the graphical representations of the frequencies covered by two smaller components 134 and 136. Larger components 126 and 128 generally provide coverage for lower frequencies, for example in the 800 MHz range, while smaller components 134 and 136 provide coverage for higher frequencies, for example in the 1900 MHz range. Thus, the frequency coverage for antenna 125 is shown in FIG. 3B is the combined coverage of components 126, 128, 134, and 136.

For purposes of this specification and the claims that follow, it can be said that antenna components 102 and 104 in FIGS. 2A and 2B are vertically aligned with respect to each other. Further, it can be said that antenna components 134 and 136 are horizontally aligned with respect to antenna elements 126 and 128 in FIG. 3A.

Multiple configurations of feeding the components 126, 128, 134 and 136 are contemplated. For example, one component can be connected to a feed line and the others can be excited by magnetic coupling. Alternatively one component in each band (i.e. 800 MHz, 1900 MHz) can be connected to a feed line and the other component in each band is excited by magnetic coupling to its counter part in the frequency band. Another possible arrangement would be to connect each component to a feed line.

FIGS. 4A, 4B, 4C and 4D illustrate the aforementioned feeding solutions plus different component placement. Components corresponding to similar frequency ranges can be placed side-by-side or inserted between the other components. These different configurations can be applied not only to two components of each frequency range but also at n components within m frequency ranges.

Figure 4A:
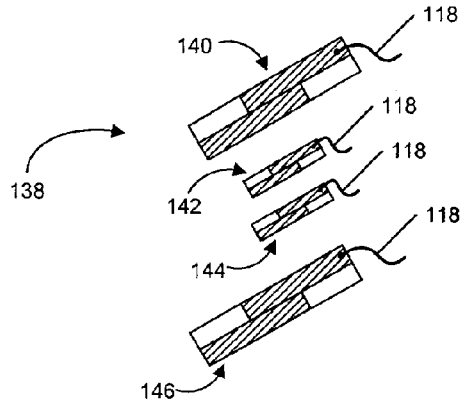
FIG. 4A is a top view of another embodiment of an antenna in accordance with the present invention.

FIG. 4A illustrates one embodiment of a multi-element, multi-band CLMD antenna 138, in accordance with the present invention. In this configuration, there are four antenna components 140, 142, 144, and 146, placed parallel to one-another. Components 140 and 146 are the larger components, each covering different frequencies within a relatively lower frequency range. Components 142 and 144, as the smaller of the four components, each cover different frequencies within a relatively higher frequency range. In this embodiment, power is supplied to each component 140, 142, 144, and 146 through separate feed lines 118. The invention can include 1 to n components and one to n feed lines.

Figure 4B:
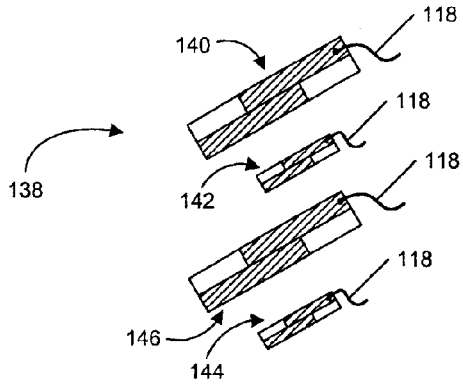
FIG. 4B is a top view of an alternative embodiment of the antenna of FIG. 4A.

FIG. 4B illustrates an alternative embodiment of the antenna 138 of FIG. 4A. In this configuration, the four separate components 140, 142, 144, and 146 again are placed parallel to one-another. However, in this arrangement, the larger components 140 and 146 and smaller components 142 and 144 are interspersed in the following order: 140; 142; 146; and 144. In this embodiment, power is supplied to each component through a separate feed line 118. Again, there can be 1 to n components and one to n feed lines.

Figure 4C:
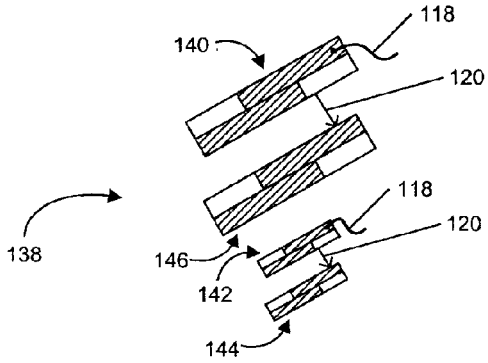
FIG. 4C is a top view of an alternative embodiment of the antenna of FIG. 4A.

FIG. 4C illustrates another alternative embodiment of the antenna 138 of FIG. 4A. In this configuration, the two larger components 140 and 146 are grouped next to each other and the two smaller components 142 and 144 are grouped next to each other, with the larger grouping next to the smaller grouping. In this embodiment, power is supplied to the two larger components 140 and 146 through a single feed line 118 attached to component 140. Power is supplied to parasitic component 156 through magnetic coupling 120. Similarly, the two smaller components 142 and 144 are also feed with a single feed line 118 attached to component 142. Power is supplied to parasitic component 144 through magnetic coupling 120.

Figure 4D:
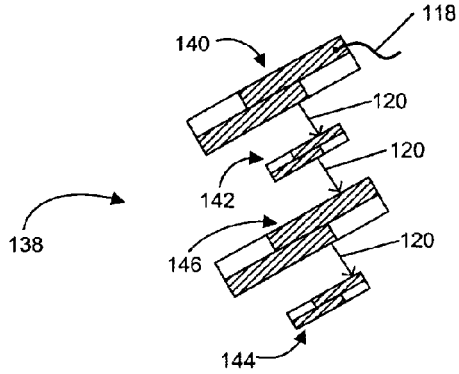
FIG. 4D is a top view of an alternative embodiment of the antenna of FIG. 4A.

FIG. 4D illustrates alternative embodiment of the antenna 138 of FIG. 4B. In this configuration, the larger components 140 and 146 are again interspersed with the smaller components 142 and 144. However, in this embodiment, power is supplied to only one component, in this example larger component 140, through feed line 118. All other components 142, 144, and 146 are powered through magnetic coupling 120, which can supply 1 to n elements.

Up to this point, the different embodiments of CLMD antennas have been presented having parallel components. As shown in FIG. 5, alternative embodiments of the invention can include stacking the components. The relative direction of one component with regard to the other is on factor in the strength of magnetic coupling between the components. When the components are arranged parallel to each other, the coupling is generally maximized and when they are orthogonal, the coupling is minimized. The two components can also be inserted one into the other for those different directions. If the larger component is placed on top, the smaller component can fit inside. Alternatively, the smaller component can be placed standing over the larger component as presented respectively in FIGS. 5A–5B and 5C–5D.

FIGS. 5A and 5B illustrate one embodiment of a multi-element, multi-band CLMD antenna 148 in which the components 150 and 152 are orthogonal to each other, in accordance with the present invention. FIG. 5A is a top view, while FIG. 5B is a side view. In this embodiment, the components 150 and 152 are arranged one inside the other, with the larger component 150 on the outside and the smaller component 152 on the inside. On the horizontal plane, either component 150 or 152 can be arranged to any angle relative to the other from 0 to 360°.

FIGS. 5C and 5D illustrate an alternative embodiment of the antenna 148 of FIGS. 5A and 5B. Again, FIG. 5C is a top view and FIG. 5D is a side view. In this embodiment, the components 150 and 152 are arranged one on top of the other. In this case, the smaller component 152 is positioned above the larger component 150. Again, on the horizontal plane, either component can be arranged to any angle relative to the other from 0 to 360°.

The aforementioned embodiments of the CLMD antenna 148 of the present invention have excellent isolation due to the high confinement of the electric field. Unfortunately, their bandwidth is relatively narrow. For some applications, the required bandwidth is too wide to use these CLMD antenna components. In order to increase the bandwidth, it is possible to relax the confinement. This relaxation can be obtained using various alternative relaxed component embodiments described below.

Figure 6A:
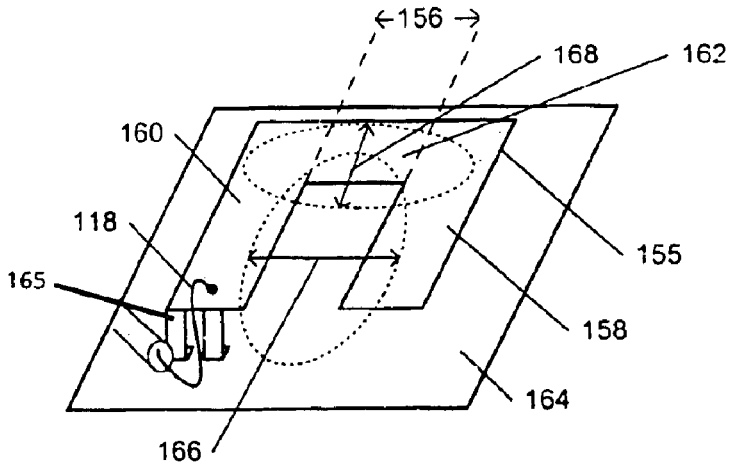
FIG. 6A is a perspective view of an alternative embodiment of a CLMD antenna component according to the present invention.

FIG. 6A illustrates one embodiment of a relaxed single-element CLMD antenna 154 comprising top section antenna element 155, a ground plate 164, at least one ground plate 165 and a feed line 118.

One way to relax the confinement antenna 154 is to increase the gap 156 between the two top plates 158 and 160. At some point, the capacitance 166 of the antenna 154 becomes too small to keep a low frequency due to the increased gap 156 size between the two top plates 158 and 160. The capacitance 166 reduction can be compensated for by increasing the inductance 168 of the antenna 154. This can be achieved by connecting the two top plates 158 and 160 with a connection section 162. In operation, the two top plates 158 and 160 and connection section 162 form a magnetic dipole field loop 170 shown in FIG. 6B.

Figure 6B:
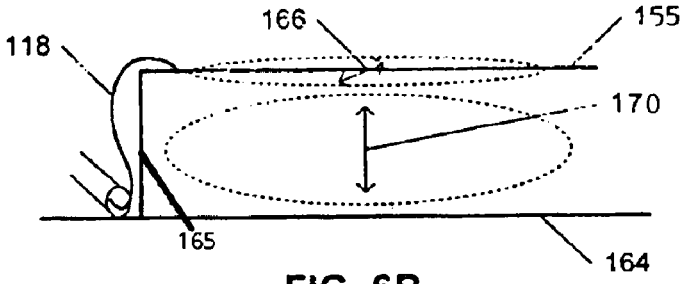
FIG. 6B is a side view of the CLMD antenna component of FIG. 6A.
Figure 6C:
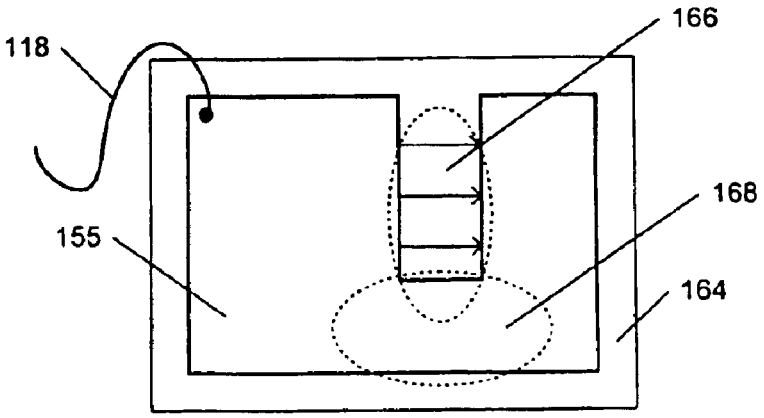
FIG. 6C is a top view of the CLMD antenna component of FIG. 6*a:*
Figure 7A:
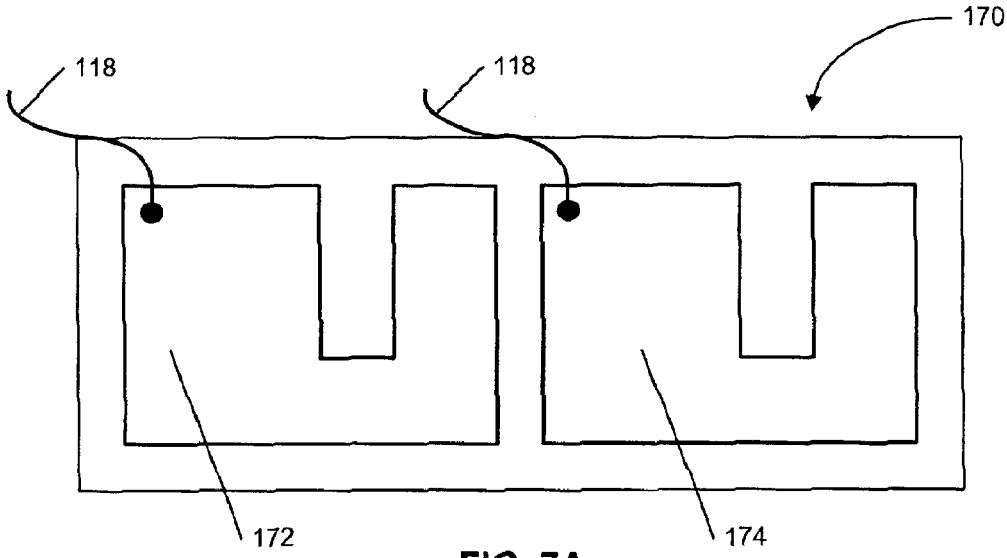
FIG. 7A is a top view of an alternative embodiment of a CLMD antenna according to the present invention.

Similar to the embodiments described above, multiple configurations of multi-element, multi-frequency relaxed CLMD antennas can be assembled using relaxed single element CLMD antennas similar to the one shown in FIGS. 6A–C. FIG. 7A illustrates one embodiment of such a multi-element, either mono or dual band CLMD antenna 170, in accordance with the present invention. Antenna 170 comprises two top section antenna elements 172 and 174, similar to top section antenna element 155 shown in FIGS. 6A–C, mounted on a ground plane 164. Alternatively, a separate ground plane can be attached to each top section antenna element. Each top section antenna element 172 and 174 is powered by a feed line 118. The top section antenna elements 172 and 174 are placed parallel to one another and each is configured for covering a specific frequency range.

Figure 7B:
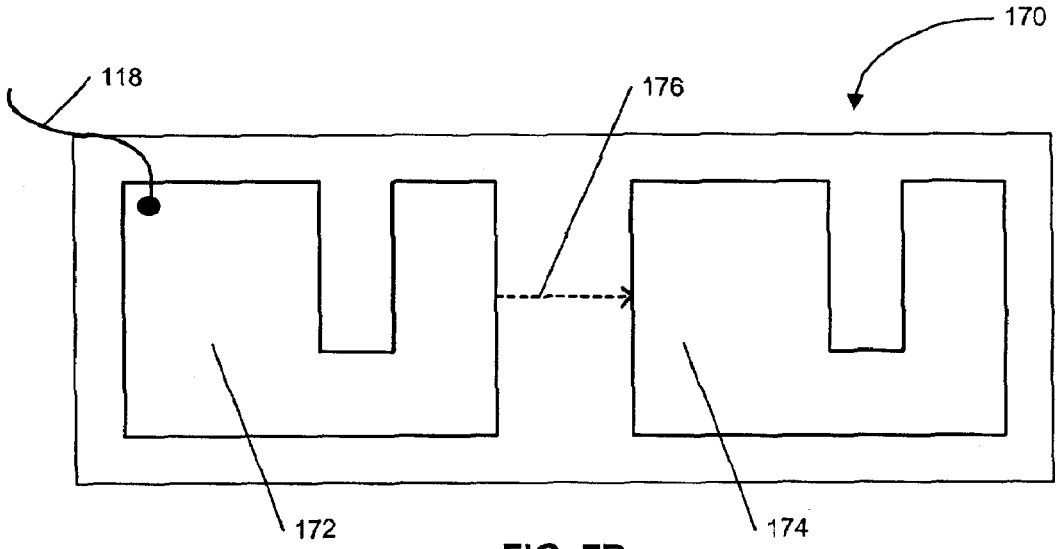
FIG. 7B is a top view of an alternative embodiment of the CLMD antenna of FIG. 7B.

FIG. 7B illustrates an alternative embodiment of the antenna of FIG. 7A in which only top section antenna element 172 is powered by a feed line 118. In this embodiment, top section antenna element 174 is powered through magnetic coupling 176 with top section antenna element 172. Magnetic coupling can be used to supply power to 1 to n elements.

Figure 8A:
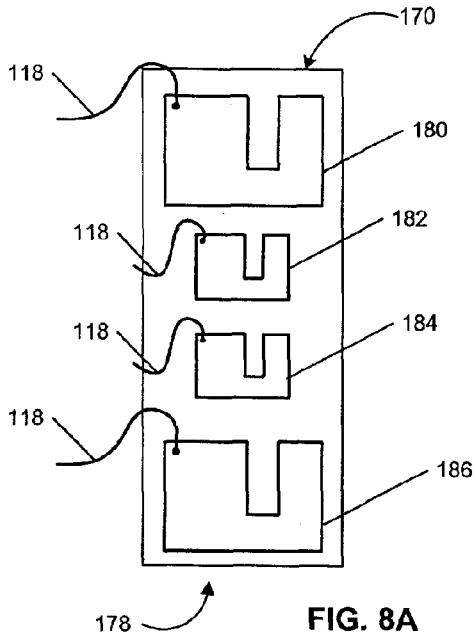
FIG. 8A is a top view of an alternative embodiment of a CLMD antenna according to the present invention.
Figure 8B:
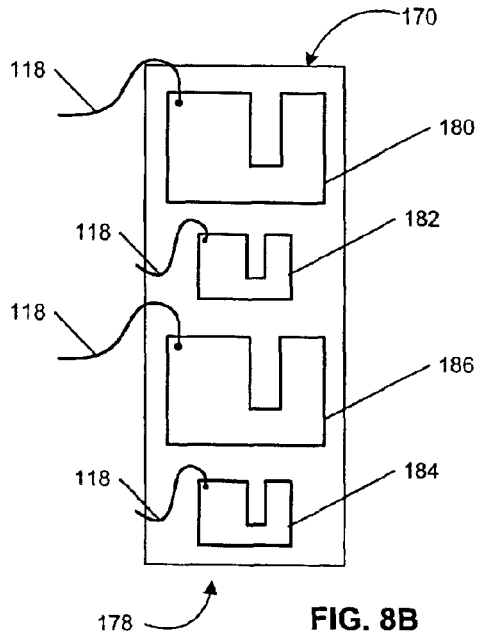
FIGS. 8B–D are top views of alternative embodiments of the antenna of FIG. 8A.
Figure 8C:
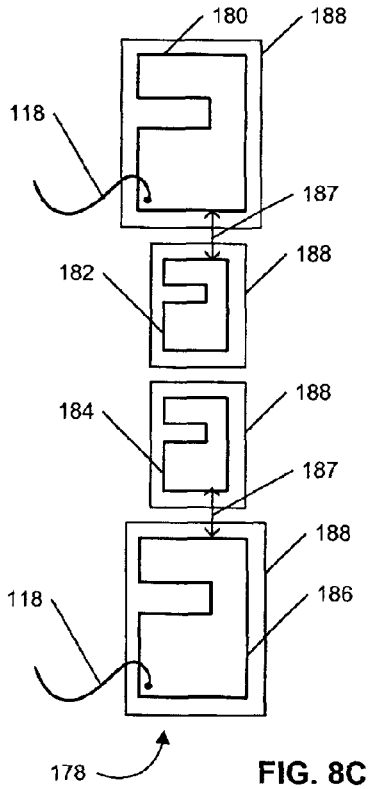
Figure 8D:
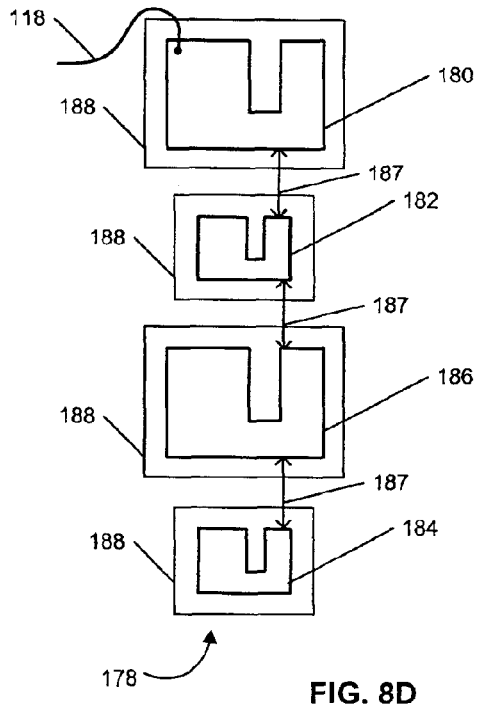

FIGS. 8A, 8B, 8C and 8D illustrate different alternative embodiments of a multi-element, multi-band CLMD antenna 178 in accordance with the present invention. The embodiments shown in FIGS. 8A and 8B each include four top section antenna elements 180, 182, 184 and 186 positioned on a common ground plate 170. FIGS. 8C and 8D include four top section antenna elements 180, 182, 184 and 186 each positioned on a separate ground plate 188. It should be noted that each of the configurations illustrated in FIGS. 8C and 8D can include a single ground plane 170 or multiple ground planes 188. In fact, this is true for all of the embodiments disclosed herein. Further, it is possible for some top sections to share a common ground plane, while the other top sections either share a separate ground plane or are associated each with their own. For example, in FIG. 8A top sections 180 and 182 can share a common ground plane, while top sections 184 and 186 either share a ground plane or have their own ground planes. In general, the ground plane configuration for all of the antenna embodiments disclosed herein will depend on the particular implementation.

In FIGS. 8A–8D, two top section antenna elements are configured for each frequency range (e.g. elements 180 and 186 are configured for one frequency range and elements 182 and 184 are configured for another frequency range) and the different embodiment illustrated in the figures show exemplary physical and powering configurations. Further, in FIGS. 8A and 8B each top section antenna element 180, 182, 184 and 186 is powered by a feed line 118. In FIG. 8C elements 180 and 186 are powered by a feeding line 118, while elements 182 and 184 are powered by magnetic coupling 187 with elements 180 and 186 respectively. In FIG. 8D, only element 180 is powered using a feed line 118, while elements 182, 184 and 186 are powered by magnetic coupling 187 with adjacent elements. Elements corresponding to the same frequency range can be placed side-by-side or inserted between elements corresponding to a different frequency range. These different configurations can be applied not only to two elements of each frequency range but also at n elements within m frequency ranges.

Figure 9A:
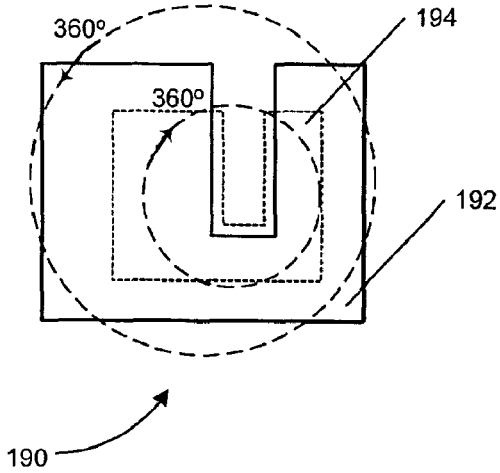
FIG. 9A is a top view of an alternative embodiment of a CLMD antenna component according to the present invention.
Figure 9B:
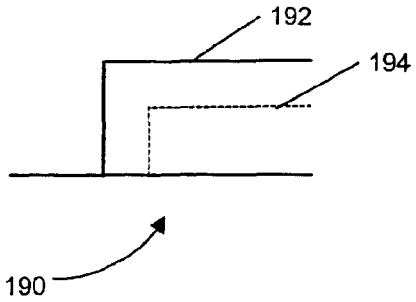
FIG. 9B is a side view of the antenna component of FIG. 9A.
Figure 9C:
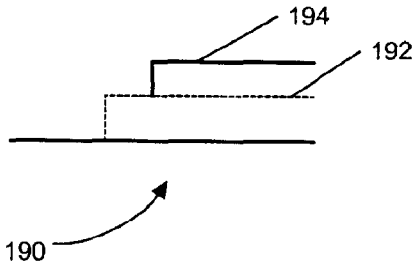
FIG. 9C is a side view of an alternative embodiment of the antenna component of FIG. 9A.

A relaxed CLMD antenna 190 can also be arranged vertically similar to the CLMD antenna shown in FIG. 5. Again, the relative direction of one antenna element related to the other will control the strength of magnetic coupling between the elements. When the elements are parallel, the coupling is maximum and when they are orthogonal, the coupling is minimum. Multiple elements can also be stacked one on top of the other to produce addition embodiment of the invention. In configurations where the top element is larger 192, other elements 194 can fit inside. In configurations where the top element is smaller 194, it can stand over the other elements 192 as presented respectively in FIGS. 9A–9B and 9C.

Figure 10A:
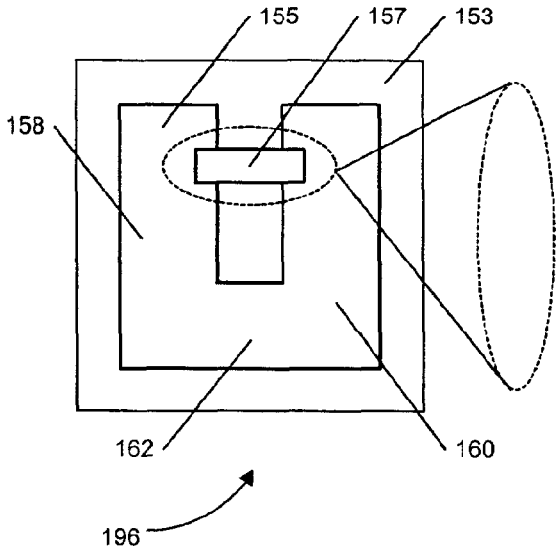
FIG. 10A is a top view of an alternative embodiment of a CLMD antenna component according to the present invention.

The bandwidth obtained with the relaxed CLMD antenna of the type illustrated in FIG. 6 may have to be increased for certain applications. In this case, the bandwidth can then be improved further by adding a bridge 157 over the slot of the top plate antenna element 155 as illustrated by the relaxed CLMD antenna 196 presented in FIG. 10A.

Figure 10B:
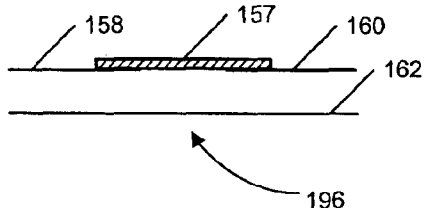
FIG. 10B is a side view of the antenna component of FIG. 10A.
Figure 10C:
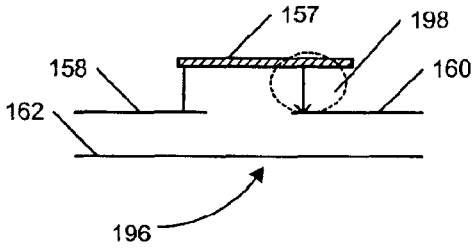
FIGS. 10C and 10D are side views of alternative embodiments of the antenna component of FIG. 10A.
Figure 10D:
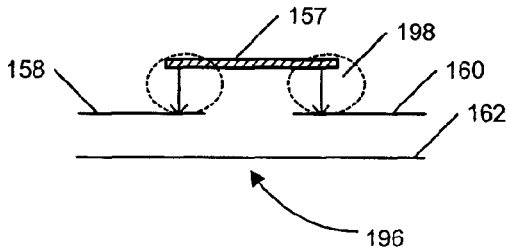

Various bridge configurations can be applied to the present invention each creating unique ways to control the interaction between the antenna and its surrounding. Several exemplary embodiments are illustrated in FIGS. 10A, 10B, 10C and 10D. The bridge 157 can be electrically connected on both top plates 158 and 160 as shown in FIG. 10B; it can be connected on one top plate 158 and capacitively loaded 198 on the other top plate 160, as shown in FIG. 10C; or it can be capacitively loaded 198 on both top plates 158 and 160 as shown in FIG. 10D.

Volume and surface area are critical issues for handheld devices. Therefore it can be advantageous to have a dual band antenna component with a low volume and surface area. A relaxed CLMD antenna component can make this because the part of the top plate that is the farthest from the feeding point has very low sensitivity. Therefore, it is possible to inscribe a second, higher frequency in this part of the first element.

Figure 11A:
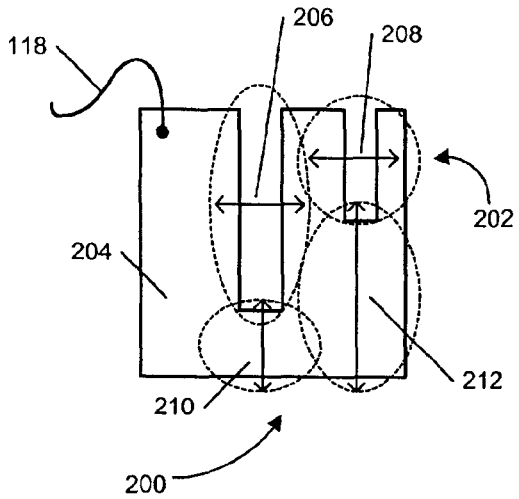
FIG. 11A is a top view of an alternative embodiment of a CLMD antenna component according to the present invention.

FIG. 11A illustrates a top-view of one embodiment of a single-element, dual-band CLMD antenna component 2000 where one antenna element 202 is inserted into another antenna element 204, in accordance with the present invention. In this embodiment areas 206 and 208 comprise the capacitive parts respectively for each band while areas 210 and 212 comprise the complementary inductive parts of the antenna 200 to keep a low frequency. Power is supplied to the antenna through a feed line 118. In this case, the antenna element 202 corresponding to the higher frequency is inserted into the lower frequency antenna element 204 and is oriented toward the same direction.

Figure 11B:
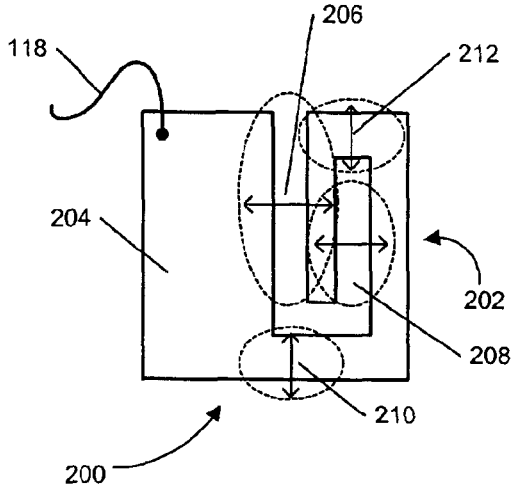
FIGS. 11B and 11C are top views of alternative embodiments of the antenna component of FIG. 11A.

FIG. 11B illustrates an alternative embodiment of a single-element, dual-band CLMD antenna component 200. In this case, the antenna element 202 corresponding to the higher frequency is inserted into the antenna element corresponding to the lower frequency and is oriented in the opposite direction with a mirror symmetry.

Figure 11C:
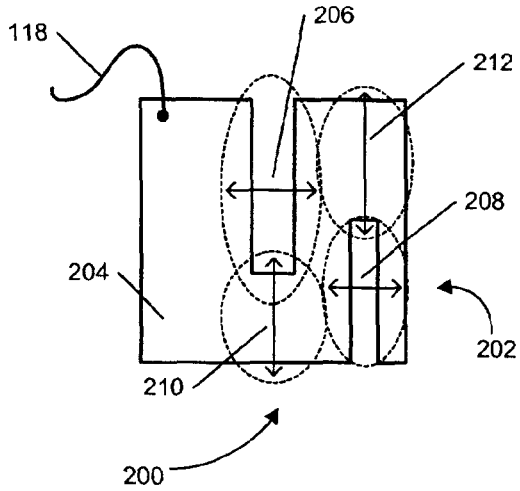

FIG. 11C illustrates a top-view of an alternative embodiment of a single-element, dual-band CLMD component 200. In this case, the antenna element 204 corresponding to the higher frequency is inserted into the lower frequency antenna element 202 and is oriented in the opposite direction.

Figure 12A:
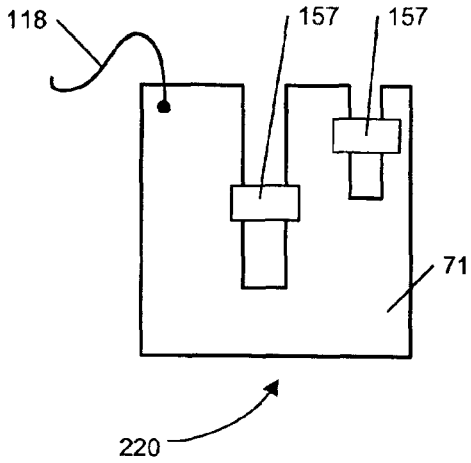
FIG. 12A is a top view of an alternative embodiment of a CLMD antenna component according to the present invention.
Figure 12B:
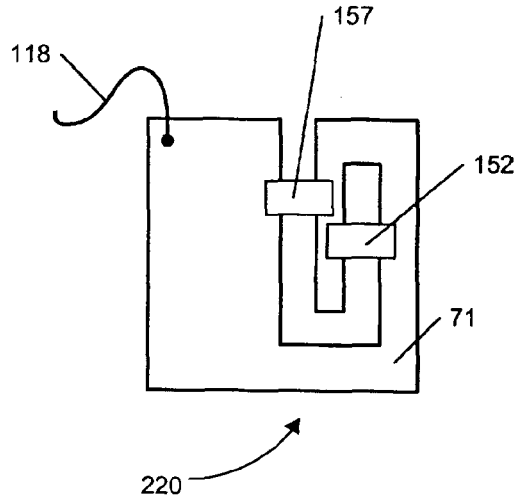
FIGS. 12B and 12C are top views of alternative embodiments of the antenna component of FIG. 12A.
Figure 12C:
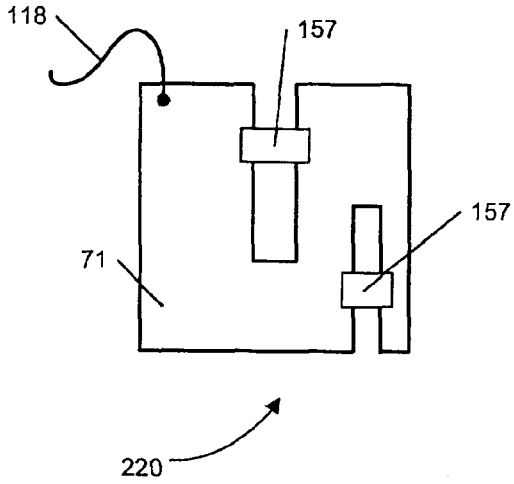

FIGS. 12A, 12B, and 12C illustrate the alternative embodiments of the antenna component 200 of FIGS. 11A, 11B and 11C respectively, in which bridges 157 are added to improve bandwidth.

Figure 13:
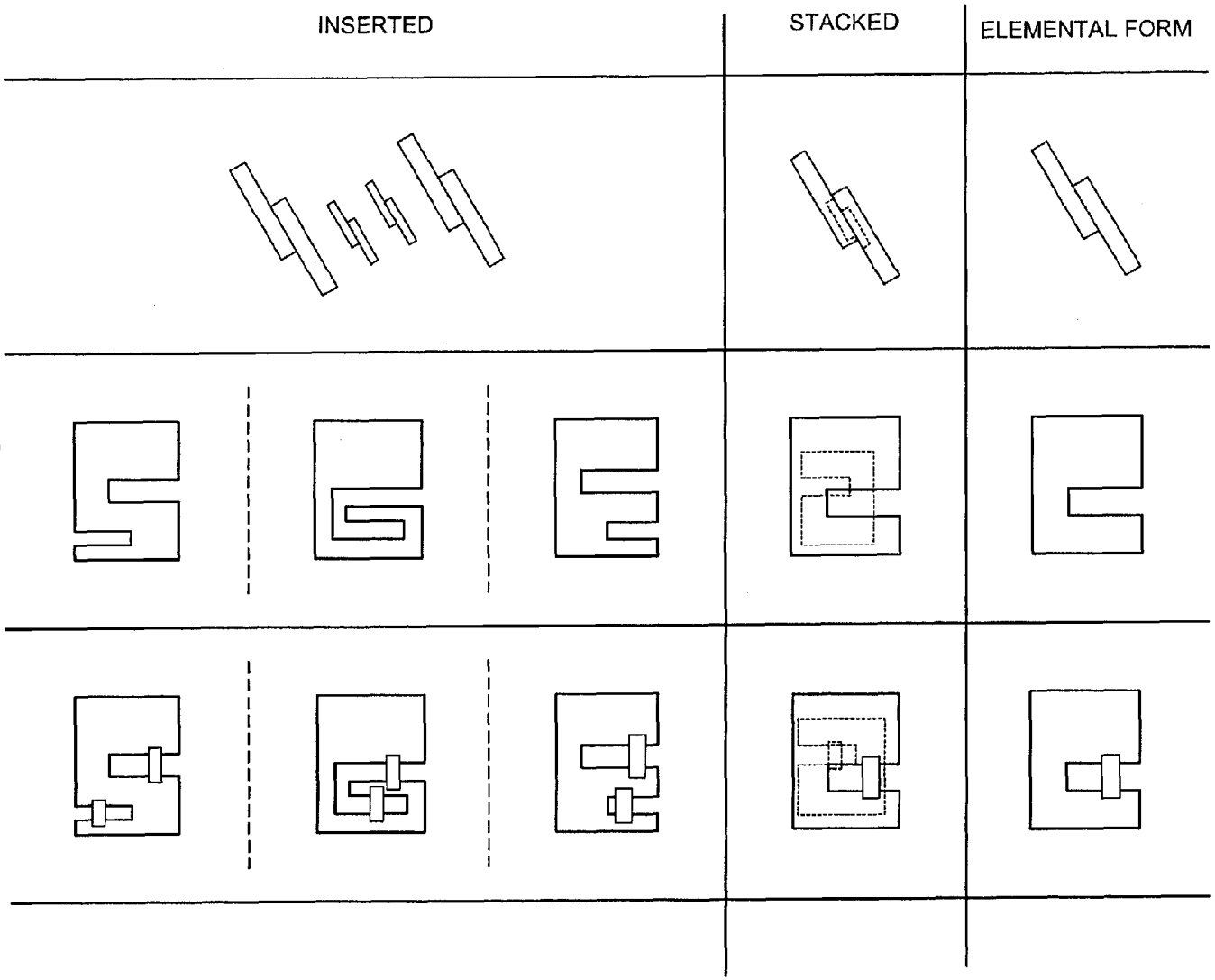
FIG. 13 is a top view of various antenna components and configures according to the present invention.

FIG. 13 summarizes the various antenna embodiments illustrated in the previous figures. The important point is that the different presented solutions can actually be mixed in order to obtain multi-bands. For example, a dual-band relaxed CLMD component can be stacked with a mono-band, relaxed, bridged CLMD component in order to obtain a tri-band antenna.

FIG. 14 shows an example of a quad-band, relaxed CLMD antenna component 220. It is comprised of a top plate, tri-band inserted CLMG antenna element 222, stacked with a mono-band regular CLMD antenna element 224 FIG. 14B illustrates an alternative embodiment of the antenna component 220 in which the top plate, tri-band inserted CLMG antenna element 222 is bridged 157.

It should also be noted that active or passive components can be placed on the under side of the ground plane of any of the antennas described herein in order to save circuit board real estate within whatever device the antenna is ultimately installed.

While embodiments and implementations of the invention have been shown and described, it should be apparent that many more embodiments and implementations are within the scope of the invention. Accordingly, the invention is not to be restricted, except in light of the claims and their equivalents.

We claim:

1. An antenna, comprising:

a first top plate having a first end, a second end opposite the first end, and two sides connecting the first end to the second end;

a second top plate having a first end, a second end opposite the first end, and two sides connecting the first end to the second end, wherein one side of the second top plate is adjacent to one side of the first top plate, the first and second top plates configured to form a capacitive part of the antenna configured to confine an electric field generated by the antenna in a horizontal plane;

a ground plane electrically connected with the first and second top plates, the ground plane configured to create an inductive part of the antenna with the first and second top plates, the inductive part configured to expel a magnetic field generated by the antenna; and an antenna feed coupled to the first end of the first top plate, wherein the first top plate, the second top plate, the ground plane, and the antenna feed are positioned to form a current distribution having a substantially circular cross-section.

2. The antenna of claim 1, wherein the antenna feed further comprises a feedline coupled with the first top plate, the feedline configured to supply power to the antenna.

3. The antenna of claim 1, wherein the electric field confinement and a frequency bandwidth of the antenna can be controlled by controlling the separation between the first and second top plates.

4. The antenna of claim 1, further comprising active or passive components installed on the under side of the ground plane in order to save circuit board real estate within a device in which the antenna is installed.

5. A multi-frequency range antenna, comprising a plurality of antenna components each configured to operate in a selected frequency range, at least one antenna component including:

a first top plate having a first end, a second end opposite the first end, and two sides connecting the first end to the second end;

a second top plate having a first end, a second end opposite the first end, and two sides connecting the first end to the second end, wherein one side of the second top plate is adjacent to one side of the first top plate, the first and second top plates configured to form a capacitive part of the antenna component configured to confine an electric field generated by the antenna component in a horizontal plane;

a ground plane electrically connected with the first and second top plates, the ground plane configured to create an inductive part of the antenna component with the first and second top plates, the inductive part configured to expel a magnetic field generated by the antenna component; and an antenna feed coupled to the first end of the first top plate, wherein the first top plate, the second top plate, the ground plane, and the antenna feed are positioned to form a current distribution having a substantially circular cross-section.

6. A multi-frequency range antenna of claim 5, wherein the size of each of the plurality of antenna components is configured so that the antenna operates in the selected frequency range.

7. The multi-frequency range antenna of claim 5, wherein the plurality of antenna components are vertically or horizontally aligned with respect to each other.

8. The multi-frequency range antenna of claim 5, wherein the antenna feed further comprises a feedline coupled to the first top plate, and wherein the feedline is configured to supply power to the antenna component with which it is coupled.

9. The multi-frequency range antenna of claim 8, wherein any antenna components not coupled with one of the plurality of feed lines is excited through magnetic coupling.

10. The multi-frequency range antenna of claim 5, wherein the antenna feed further comprises a feedline coupled to the first top plate of at least one of the plurality of antenna components, wherein the feedline is configured to supply power to the antenna component with which it is coupled, and wherein the remaining antenna components are excited through magnetic coupling.

11. The multi-frequency range antenna of claim 5, wherein the antenna components are stacked within or on top of each other.

12. The multi-frequency range antenna of claim 5, wherein at least some of the plurality of antenna components share a common ground plane.

13. The multi-frequency range antenna of claim 5, wherein the selected frequency ranges of the plurality of antenna components comprise a single frequency band.

14. The multi-frequency range antenna of claim 5, wherein the selected frequency ranges of the plurality of antenna components comprise a plurality of frequency bands, and wherein the antenna components are grouped by frequency band.

15. The multi-frequency range antenna of claim 14, wherein antenna components of the same frequency band can be aligned vertically or horizontally with respect to each other.

16. The multi-frequency range antenna of claim 14, wherein antenna components of the same frequency band can be aligned vertically or horizontally with respect to antenna components of other frequency bands.

17. The multi-frequency range antenna of claim 14, wherein the antenna components of the same frequency band can be stacked within or on top of each other.

18. The multi-frequency range antenna of claim 14, wherein the antenna components of the same frequency band can be grouped together next to antenna components of other frequency bands or interspersed with antenna components of other frequency bands.

19. The multi-frequency range antenna of claim 5, further comprising active or passive components installed on the under side of the ground plane in order to save circuit board real estate within a device in which the antenna is installed.

20. An antenna, comprising:

a top section comprising a first top plate having a first end, a second end opposite the first end, and two sides connecting the first end and second end, a second top plate adjacent to the first top plate, and a connection section connecting one side of the first top plate to the second top plate near the second end of the first top plate, the first and second top plates configured to form a capacitive part of the antenna configured to confine an electric field generated by the antenna in a horizontal plane;

a ground plane electrically connected with the top section, the ground plane configured to create an inductive part of the antenna with the first and second top plates, the inductive part configured to expel a magnetic field generated by the antenna;

an antenna feed coupled to the first end of the first top plate, and a ground point, separate from the antenna feed, coupled to the first end of the first top plate;

wherein the first top plate, the second top plate, the connection section, the ground plane, and the antenna feed are positioned to form a current distribution having a substantially circular cross-section.

21. The antenna of claim 20, wherein the antenna feed further comprises a feedline coupled with the first top plate, the feedline configured to supply power to the antenna.

22. The antenna of claim 20, wherein the electric field confinement of the antenna can be controlled by controlling the separation between the first and second top plates.

23. The antenna of claim 20, wherein the connection section controls, at least in part, the frequency bandwidth of the antenna.

24. The antenna of claim 20, further comprising a bridge configured to extend across a gap between the first and second top plates, wherein the inductance of the inductive section is controlled at least in part by the bridge.

25. The antenna of claim 24, wherein the bridge is electrically connected with at least one of the first and second top plates.

26. The antenna of claim 24, wherein the bridge is capacitively loaded with respect to at least one of the first and second top plates.

27. The antenna of claim 20, further comprising active or passive components installed on the under side of the ground plane in order to save circuit board real estate within a device in which the antenna is installed.

28. A multi-frequency range antenna, comprising a plurality of antenna components, at least one antenna component comprising:

a top section comprising a first top plate having a first end, a second end opposite the first end, and two sides connecting the first end and the second end, a second top plate adjacent to the first top plate, and a connection section connecting one side of the first top plate to the second top plate near the second end of the first top plate, the first and second top plates configured to form a capacitive part of the antenna component configured to confine an electric field generated by the antenna component in a horizontal plane;

a ground plane electrically connected with the top section, the ground plane configured to create an inductive part of the antenna component with the first and second top plates, the inductive part configured to expel a magnetic field generated by the antenna component;

an antenna feed coupled to the first end of the first top plate, and a ground point, separate from the antenna feed, coupled to the first end of the first top plate;

wherein the first top plate, the second top plate, the connection section, the ground plane, and the antenna feed are positioned to form a current distribution having a substantially circular cross-section.

29. The multi-frequency range antenna of claim 28, wherein the plurality of antenna components are vertically or horizontally aligned with respect to each other.

30. The multi-frequency range antenna of claim 28, wherein the antenna feed further comprises a feedline coupled to the first top plate, and wherein the feedline is configured to supply power to the antenna component with which it is coupled.

31. The multi-frequency range antenna of claim 30, wherein any antenna components not coupled with one of the plurality of feed lines is excited through magnetic coupling.

32. The multi-frequency range antenna of claim 28, wherein the antenna feed further comprises a feedline coupled to the first top plate of at least one of the plurality of antenna components, wherein the feedline is configured to supply power to the antenna component with which it is coupled, and wherein the remaining antenna components are excited through magnetic coupling.

33. The multi-frequency range antenna of claim 28, wherein the antenna components are stacked within or on top of each other.

34. The multi-frequency range antenna of claim 28, wherein at least some of the plurality of antenna components share a common ground plane.

35. The multi-frequency range antenna of claim 28, wherein the selected frequency ranges of the plurality of antenna components comprise a single frequency band.

36. The multi-frequency range antenna of claim 28, wherein the selected frequency ranges of the plurality of antenna components comprise a plurality of frequency bands, and wherein the antenna components are grouped by frequency band.

37. The multi-frequency range antenna of claim 36, wherein antenna components of the same frequency band can be aligned vertically or horizontally with respect to each other.

38. The multi-frequency range antenna of claim 36, wherein antenna components of the same frequency band can be aligned vertically or horizontally with respect to antenna components of other frequency bands.

39. The multi-frequency range antenna of claim 36, wherein the antenna components of the same frequency band can be stacked within or on top of each other.

40. The multi-frequency range antenna of claim 36, wherein the antenna components of the same frequency band can be grouped together next to antenna components of other frequency bands or interspersed with antenna components of other frequency bands.

41. The multi-frequency range antenna of claim 28, further comprising active or passive components installed on the under side of the ground plane in order to save circuit board real estate within a device in which the antenna is installed.

42. A multi-frequency band antenna, comprising:

a top section, the top section comprising a plurality of antenna components, at least one antenna component comprising:

a first top plate having a first end, a second end opposite the first end, and two dies connecting the first end and second end, a second top plate adjacent to the first top plate, and a connection section connecting one side of the first top plate to the second top plate near the second end of the first top plate, the first and second top plates configured to form a capacitive part of the antenna component configured to confine an electric field generated by the antenna component in a horizontal plane;

an antenna feed coupled to the first end of the first top plate, and a ground point, separate from the antenna feed, coupled to the first end of the first top plate; and a ground plane electrically connected with the top section, the ground plane configured to create an inductive part of each of the plurality of antenna components with the first and second top plates of each of the plurality of antenna components, the inductive part configured to expel a magnetic field generated by each of the plurality of antenna components;

wherein the first top plate, the second top plate, the connection section, the ground plane, and the antenna feed are positioned to form a current distribution having a substantially circular cross-section on the at least one antenna component.

43. The multi-frequency band antenna of claim 42, wherein at least some of the antenna components of the plurality of antenna components share at least one of the first and second top plates in common with other antenna components of the plurality of antenna components.

44. The multi-frequency band antenna of claim 42, wherein the antenna feed further comprises a feedline coupled to the first top section, the feedline configured to supply power to the multi-frequency band antenna.

45. The multi-frequency band antenna of claim 42, wherein the electric field confinement of each of the plurality of antenna components can be controlled by controlling the separation between the first and second top plates of each of the plurality of antenna components.

46. The multi-frequency band antenna of claim 42, further comprising a bridge configured to extend across a gap between the first and second top plates of one of the plurality of antenna components, wherein the inductance of the inductive section of antenna component is controlled at least in part by the bridge.

47. The multi-frequency band antenna of claim 46, wherein the bridge is electrically connected with the first and second top plates of the antenna component.

48. The multi-frequency band antenna of claim 46, wherein the bridge is capacitively loaded with respect to at least one of the first and second top plates of the antenna component.

49. The multi-frequency band antenna of claim 42, further comprising a mono-band antenna stacked inside the cavity created between the top section and ground plane.

50. The multi-frequency band antenna of claim 42, further comprising active or passive components installed on the under side of the ground plane in order to save circuit board real estate within a device in which the antenna is installed.

* * * * *